US010866561B2

(12) United States Patent
Shimizu

(10) Patent No.: US 10,866,561 B2
(45) Date of Patent: Dec. 15, 2020

(54) DEVELOPING CARTRIDGE INCLUDING FIRST GEAR AND SECOND GEAR ROTATABLE RELATIVE TO FIRST GEAR

(71) Applicant: BROTHER KOGYO KABUSHIKI KAISHA, Nagoya (JP)

(72) Inventor: Keita Shimizu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/506,051

(22) Filed: Jul. 9, 2019

(65) Prior Publication Data

US 2020/0073318 A1 Mar. 5, 2020

(30) Foreign Application Priority Data

Aug. 30, 2018 (JP) ..... 2018-161219

(51) Int. Cl.
*G03G 21/18* (2006.01)
*G03G 21/16* (2006.01)
*G03G 15/08* (2006.01)

(52) U.S. Cl.
CPC ..... *G03G 21/1896* (2013.01); *G03G 15/0863* (2013.01); *G03G 15/0865* (2013.01); *G03G 21/1647* (2013.01); *G03G 21/1676* (2013.01)

(58) Field of Classification Search
CPC ..... G03G 21/1875; G03G 21/1896; G03G 21/1647; G03G 15/0863; G03G 2215/0695
See application file for complete search history.

(56) References Cited

U.S. PATENT DOCUMENTS 10,054,901 B1 * 8/2018 Fukamachi ..... G03G 15/0863
2008/0205911 A1 * 8/2008 Ishikawa ..... G03G 15/0896 399/12
2011/0236062 A1 9/2011 Takagi
2015/0277356 A1 * 10/2015 Mushika ..... G03G 21/1647 399/12
2017/0097607 A1 * 4/2017 Watanabe ..... G03G 21/1647
2017/0123346 A1 * 5/2017 Shimizu ..... G03G 15/0896

FOREIGN PATENT DOCUMENTS

JP 2011-203362 A 10/2011

* cited by examiner

*Primary Examiner* — Carla J Therrien
(74) *Attorney, Agent, or Firm* — Merchant & Gould P.C.

(57) ABSTRACT

A developing cartridge includes a casing, a drive gear, a first gear, and a second gear rotatable relative to the first gear. The drive gear includes a small-diameter gear part, and a large-diameter gear part. The first gear includes: a first gear teeth part having a plurality of gear teeth; and a first protrusion movable in accordance with rotation of the first gear teeth part. The second gear includes: a second gear teeth part having at least one gear tooth; and a second protrusion movable in accordance with rotation of the second gear teeth part. The second gear teeth part is configured to meshingly engage with the large-diameter gear part to rotate the second gear after the first gear rotates by a prescribed angle by meshing engagement between the small-diameter gear part and the first gear teeth part.

10 Claims, 13 Drawing Sheets

DEVELOPING CARTRIDGE INCLUDING FIRST GEAR AND SECOND GEAR ROTATABLE RELATIVE TO FIRST GEAR

CROSS REFERENCE TO RELATED APPLICATION

This application claims priority from Japanese Patent Application No. 2018-161219 filed Aug. 30, 2018. The entire content of the priority application is incorporated herein by reference.

TECHNICAL FIELD

The present disclosure relates to a developing cartridge used for an image forming apparatus.

BACKGROUND

Conventionally, there have been known image forming apparatuses including developing cartridges. One of such image forming apparatuses is known to determine whether or not the developing cartridge is attached or to identify a specification of the developing cartridge. For example, a prior art discloses a developing cartridge including a detection gear and protrusions movable in accordance with rotation of the detection gear. In this configuration, an image forming apparatus detects the protrusions by means of a sensor to determine whether the developing cartridge is attached.

SUMMARY

In order to identify the specification of a developing cartridge by detecting protrusions thereof, arrangement patterns of the protrusions are made different according to the specifications. With this structure, the image forming apparatus can identify a particular specification of each developing cartridge from among a plurality of specifications. In recent years, there is a demand for new gear structures of the developing cartridges in response to diversification of the specifications of the developing cartridges.

In view of the foregoing, it is an object of the present disclosure to provide a developing cartridge having a new gear structure that can be used for identifying a specification of the developing cartridge.

In order to attain the above and other objects, the disclosure provides a developing cartridge including a casing, a drive gear, a first gear, and a second gear. The casing is configured to accommodate developer therein. The drive gear includes a small-diameter gear part, and a large-diameter gear part having a diameter greater than a diameter of the small-diameter gear part. The first gear has a peripheral surface and includes a first gear teeth part and a first protrusion. The first gear teeth part has a plurality of gear teeth along a portion of the peripheral surface and the first gear teeth part is meshingly engageable with the small-diameter gear part. The first protrusion is movable in accordance with rotation of the first gear teeth part. The second gear is rotatable relative to the first gear. The second gear has a peripheral surface and includes second gear teeth part and a second protrusion. The second gear teeth part has at least one gear tooth along a portion of the peripheral surface of the second gear. The second gear teeth part is meshingly engageable with the large-diameter gear part. The second protrusion is movable in accordance with rotation of the second gear teeth part. The second gear teeth part is configured to meshingly engage with the large-diameter gear part to rotate the second gear after the first gear rotates by a prescribed angle by meshing engagement between the small-diameter gear part and the first gear teeth part.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a developing cartridge 10 according to one embodiment of the present disclosure will be descried in detail with reference to accompanying drawings.

Figure 1:
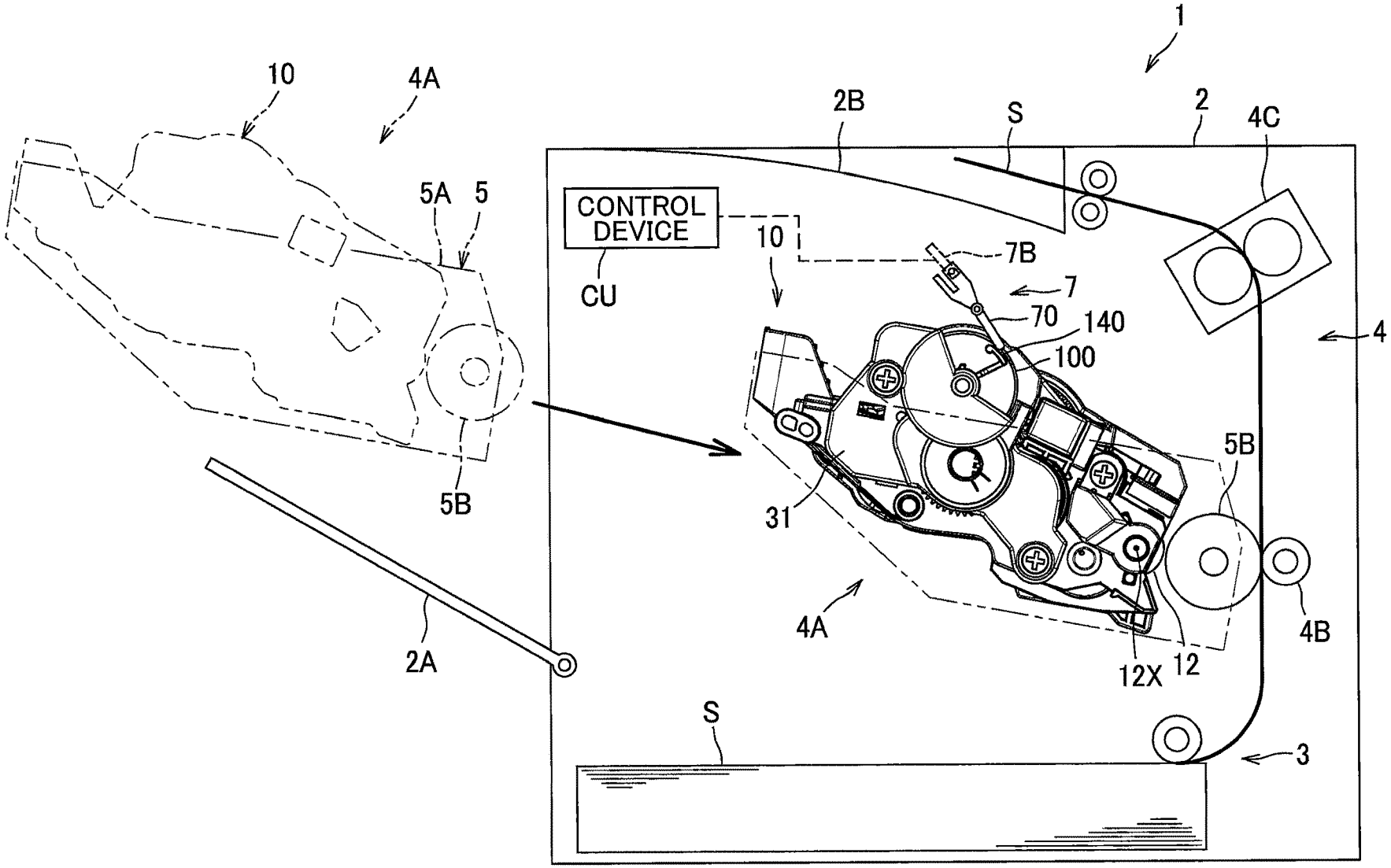
FIG. 1 is a diagram illustrating an overall configuration of a laser printer including a developing cartridge according to one embodiment of the present disclosure.

As illustrated in FIG. 1, a laser printer 1 is an image forming apparatus configured to use the developing cartridge 10 according to the embodiment. The laser printer 1 includes a main body housing 2, a sheet supply portion 3, an image forming portion 4, and a control device CU.

The main body housing 2 includes a front cover 2A, and a sheet discharge tray 2B that is positioned at an upper end portion of the main body housing 2. In the main body housing 2, the sheet supply portion 3 and the image forming portion 4 are accommodated. In a state where the front cover 2A is opened, the developing cartridge 10 can be detachably attached to the main body housing 2.

The sheet supply portion 3 accommodates sheets of paper S therein. The sheet supply portion 3 is configured to supply the sheets S one by one to the image forming portion 4.

The image forming portion 4 includes a process cartridge 4A, an exposure device (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5 to constitute the process cartridge 4A, the developing cartridge 10 is attached to and detached from the main body housing 2 as the process cartridge 4A. The photosensitive cartridge 5 includes a frame 5A and a photosensitive drum 5B rotatably supported by the frame 5A.

Figure 2:
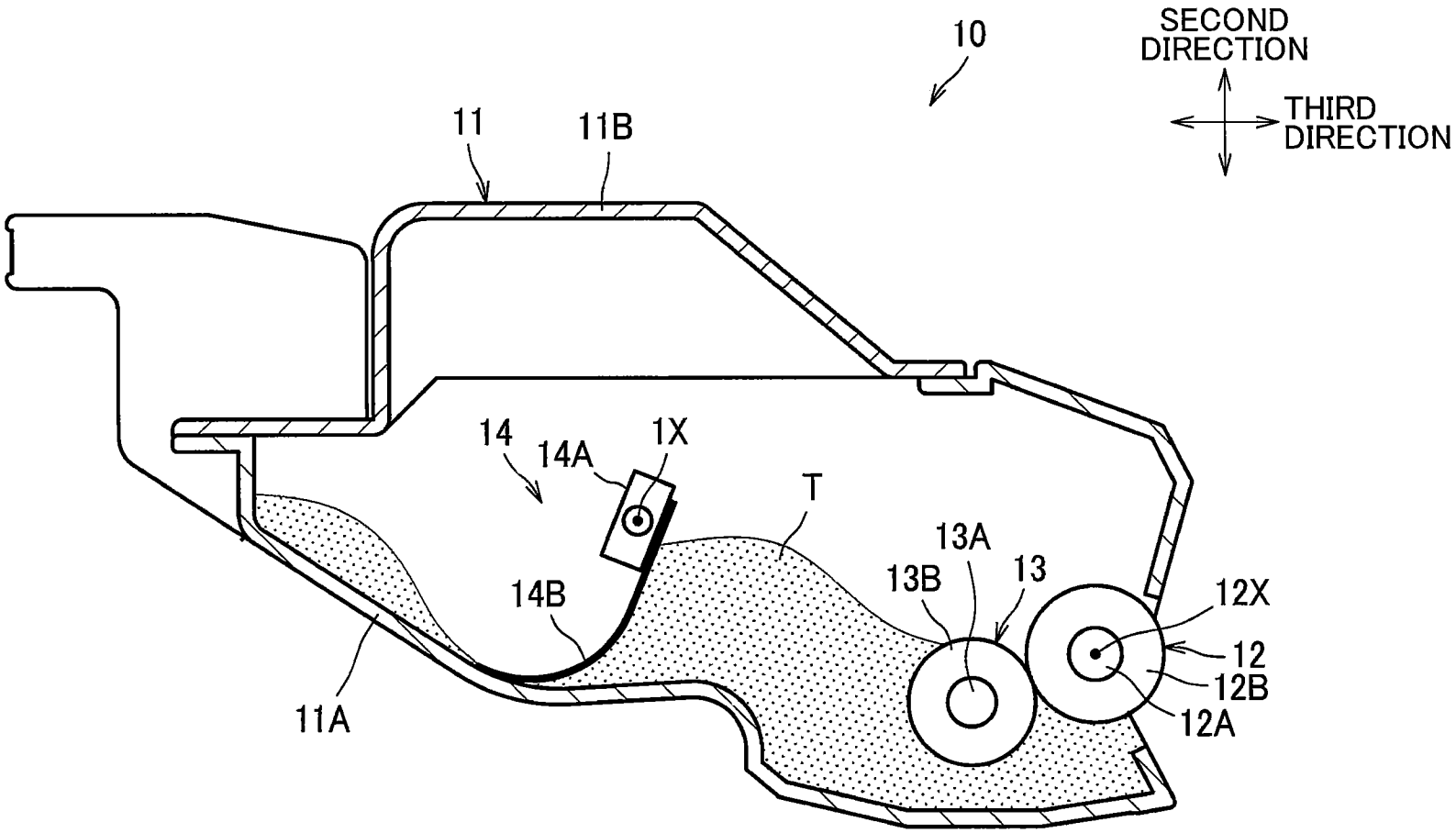
FIG. 2 is a cross-sectional view illustrating a configuration of a casing of the developing cartridge according to the embodiment.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to store toner T therein. The toner T is an example of developer.

The developing roller 12 includes a developing roller shaft 12A extending in a first direction, and a roller portion 12B. The first direction is parallel to an axial direction of a drive gear 50 (described later). Hereinafter, the first direction is also simply referred to as the axial direction. The roller portion 12B covers an outer circumferential surface of the developing roller shaft 12A. The roller portion 12B is made of, for example, electrically conductive rubber.

The developing roller 12 is rotatable about an axis of the developing roller shaft 12A. In other words, the developing roller 12 is rotatable about a third axis 12X extending in the first direction. The developing roller 12 is supported by the casing 11 so as to be rotatable about the axis of the developing roller shaft 12A. That is, the roller portion 12B of the developing roller 12 is rotatable together with the developing roller shaft 12A. A developing bias is applied to the developing roller 12 by the control device CU.

The container 11A and the lid 11B of the casing 11 face each other in a second direction. The second direction is a direction crossing the first direction. Preferably, the second direction is orthogonal to the first direction. The developing roller 12 is positioned at one end portion of the casing 11 in a third direction. Here, the third direction is a direction crossing both the first direction and the second direction. Preferably, the third direction is orthogonal to both the first direction and the second direction.

The supply roller 13 includes a supply roller shaft 13A extending in the first direction, and a roller portion 13B. The roller portion 13B covers an outer circumferential surface of the supply roller shaft 13A. The roller portion 13B is made of sponge, for example. The supply roller 13 is rotatable about an axis of the supply roller shaft 13A. That is, the roller portion 13B of the supply roller 13 is rotatable together with the supply roller shaft 13A.

The agitator 14 includes an agitator shaft 14A, and a flexible sheet 14B. The agitator shaft 14A is rotatable about a first axis 1X thereof extending in the first direction. The agitator shaft 14A is supported by the casing 11 so as to be rotatable about the first axis 1X. The flexible sheet 14B has a base end fixed to the agitator shaft 14A and a free end configured to contact an inner surface of the casing 11. The agitator 14 is configured to agitate the toner T by the flexible sheet 14B during rotation.

As illustrated in FIG. 1, the transfer roller 4B faces the photosensitive drum 5B. The transfer roller 4B is configured to convey the sheet S with while nipping the sheet S with the photosensitive drum 5B.

The photosensitive drum 5B is configured to be charged by a charger (not illustrated), and is exposed to light by the exposure device, whereby an electrostatic latent image is formed on the photosensitive drum 5B. The developing cartridge 10 is configured to supply the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C is configured to thermally fix the toner image having transferred to the sheet S thereto. The sheet S to which the toner image has been thermally fixed is then discharged onto the sheet discharge tray 2B outside the main body housing 2.

The control device CU is a device configured to control overall operations of the laser printer 1.

The laser printer 1 includes a sensor 7. The sensor 7 is configured to detect whether or not the developing cartridge 10 is a new cartridge, or to identify a specification of the developing cartridge 10. The sensor 7 includes a lever 70 pivotably movably supported by the main body housing 2, and an optical sensor 7B.

The lever 70 is at such a position that the lever 70 can contact a first protrusion 140, a second protrusion 240, and a third protrusion 150 (described later). The optical sensor 7B is electrically connected to the control device CU and is configured to output a detection signal to the control device CU. The control device CU is configured to identify the specification and the like of the developing cartridge 10 on a basis of the detection signal received from the optical sensor 7B. The optical sensor 7B is configured to detect displacement of the lever 70 and transmit the detection signal to the control device CU. More specifically, for example, the optical sensor 7B may be a sensor unit including a light-emitting portion and a light-receiving portion. The details will be described later.

Next, a detailed configuration of the developing cartridge 10 will be described.

Figure 3:
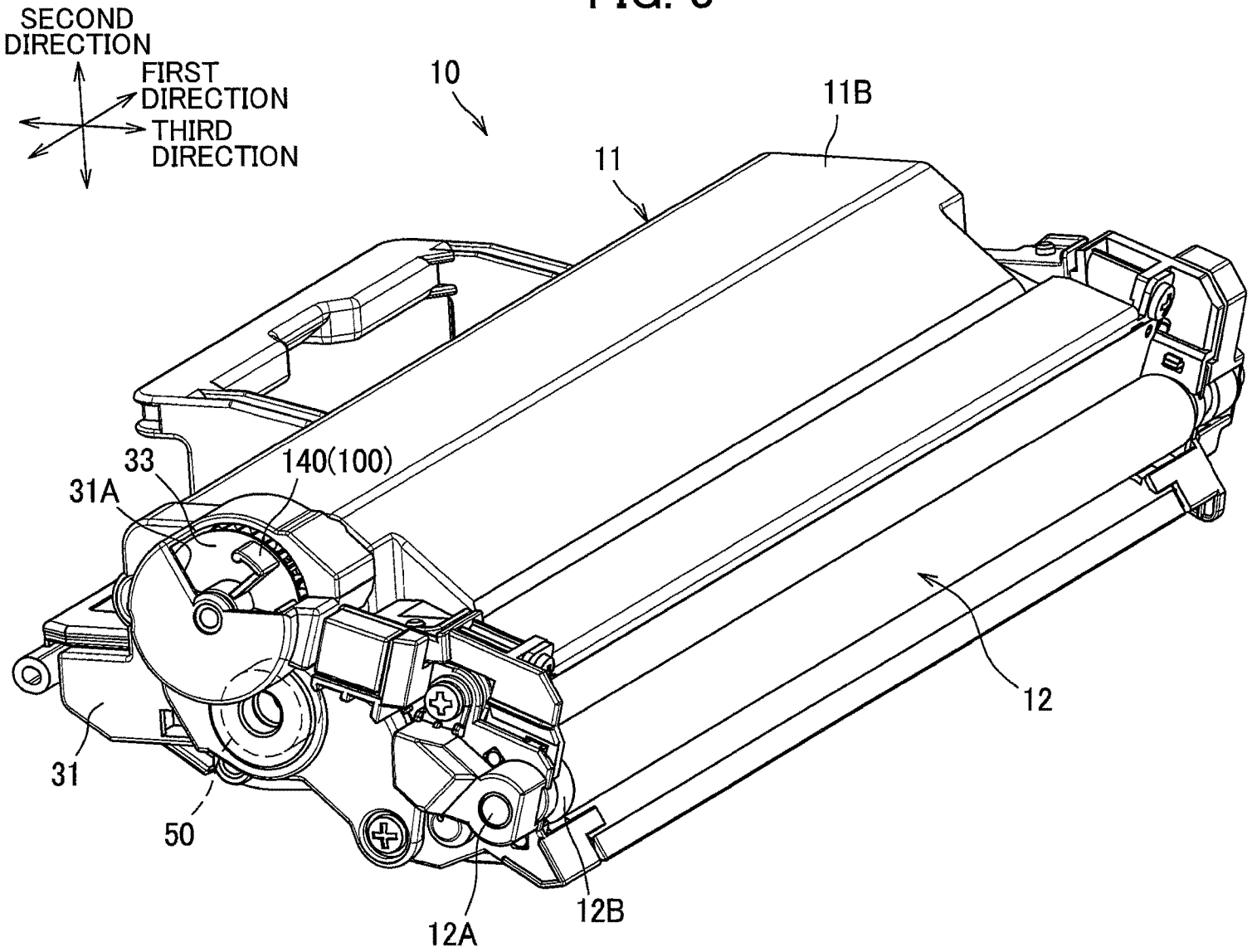
FIG. 3 is a perspective view of the developing cartridge according to the embodiment as viewed from a perspective outward thereof in a first direction.
Figure 4:
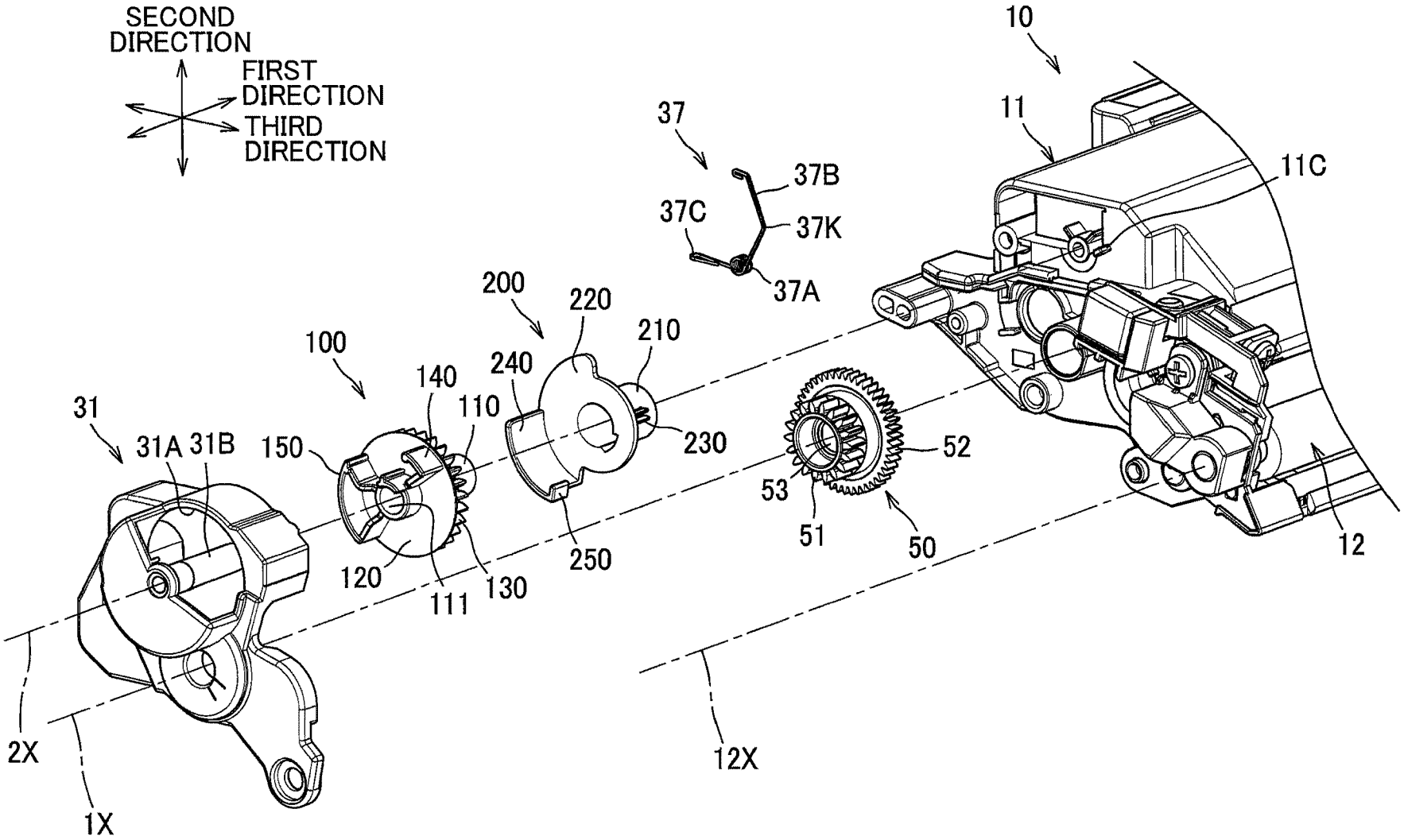
FIG. 4 is an exploded perspective view illustrating parts constituting one end portion in the first direction of the developing cartridge according to the embodiment.

As illustrated in FIGS. 3 and 4, the developing cartridge 10 further includes a gear cover 31, a torsion spring 37, the drive gear 50, a first gear 100 and a second gear 200. The gear cover 31, torsion spring 37, drive gear 50, first gear 100 and second gear 200 are positioned at one end portion of the casing 11 in the first direction.

A stopper 11C is on an outer surface of the one end portion of the casing 11 in the first direction to protrude outward therefrom.

The gear cover 31 is a cover for covering at least part of the first gear 100 and second gear 200. Specifically, the gear cover 31 has an opening 31A through which part of the first gear 100 and second gear 200 are exposed. The gear cover 31 also includes a shaft 31B extending in the first direction.

The torsion spring 37 includes a coil part 37A, a first arm 37B and a second arm 37C. The first arm 37B extends from the coil part 37A. The second arm 37C also extends from the coil part 37A. The second arm 37C is in contact with the gear cover 31 to engage therewith. The first arm 37B has a bent portion 37K that is bent to form a V shape.

The drive gear 50 includes a small-diameter gear part 51 and a large-diameter gear part 52. The drive gear 50 also has a mount hole 53 at a center thereof. The small-diameter gear part 51 has gear teeth on an entire circumference thereof. The large-diameter gear part 52 has gear teeth on an entire circumference thereof. The large-diameter gear part 52 has a diameter greater than a diameter of the small-diameter gear part 51. More specifically, an addendum circle defined by the large-diameter gear part 52 is greater than an addendum circle defined by the small-diameter gear part 51.

The drive gear 50 is attached to the agitator shaft 14A by engagement of the mount hole 53 with the agitator shaft 14A. The drive gear 50 is thus rotatable about the first axis 1X. In the present embodiment, the drive gear 50 serves as an agitator gear rotatable together with the agitator 14. The drive gear 50 is rotatably supported by the casing 11.

The first gear 100 is rotatable about a second axis 2X extending in an axial direction parallel to the first direction. The first gear 100 is rotatable by meshing engagement thereof with the drive gear 50. The first gear 100 includes a cylindrical part 110, a disk-shaped part 120, a first gear teeth part 130, the first protrusion 140, and the third protrusion 150. The first gear teeth part 130 is positioned on an inner surface of the disk-shaped part 120 in the first direction. The first protrusion 140 and third protrusion 150 are provided on an outer surface of the disk-shaped part 120 in the first direction.

The cylindrical part 110 has a hole 111 through which the shaft 31B of the gear cover 31 penetrates. The first gear 100 is thus rotatable about the shaft 31B of the gear cover 31.

The disk-shaped part 120 has a circular plate-like shape, and extends in a direction crossing the first direction. Preferably, the disk-shaped part 120 extends in a direction orthogonal to the first direction.

Figure 5A:
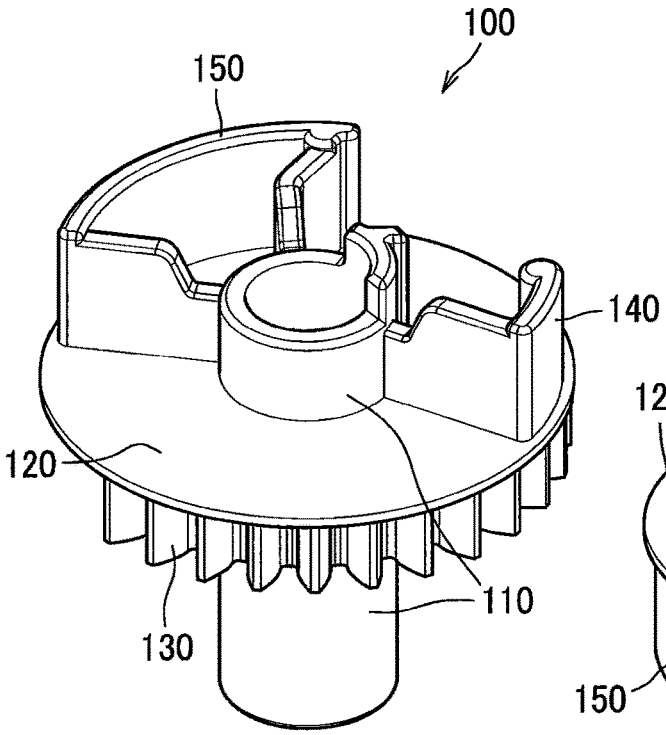
FIG. 5A is a perspective view of a first gear constituting the one end portion of the developing cartridge according to the embodiment as viewed from a perspective outward thereof in the first direction.
Figure 5B:
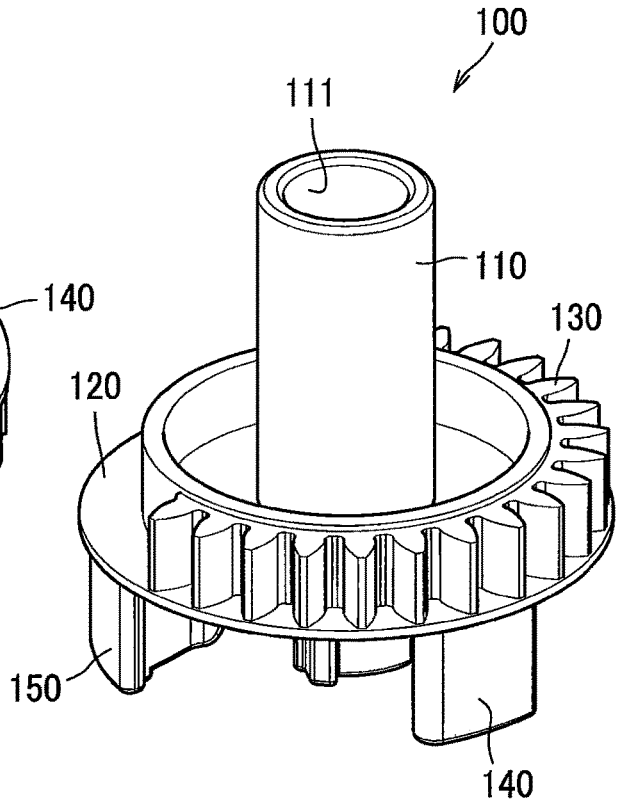
FIG. 5B is a perspective view of the first gear of the developing cartridge according to the embodiment as viewed from a perspective inward thereof in the first direction.
Figure 5C:
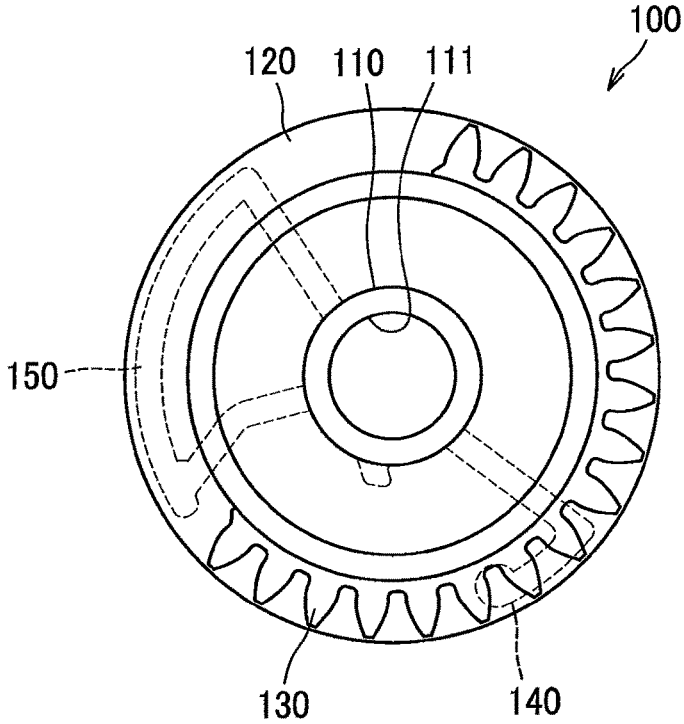
FIG. 5C is a plan view of the first gear of the developing cartridge according to the embodiment as viewed from a perspective inward thereof in the first direction.

As illustrated in FIGS. 5A to 5C, the first gear teeth part 130 is provided along a portion of an outer peripheral surface of the first gear 100. The first gear teeth part 130 is configured of a plurality of gear teeth arranged along a portion of a circumference of the disk-shaped part 120. The first gear teeth part 130 is meshingly engageable with the small-diameter gear part 51 of the drive gear 50.

The first protrusion 140 protrudes outward in the first direction from the outer surface of the disk-shaped part 120. The first protrusion 140 extends radially outward from the cylindrical part 110 on the outer surface of the disk-shaped part 120. The first protrusion 140 is at a position overlapping with the first gear teeth part 130 as viewed in the first direction (see FIG. 5C). The first protrusion 140 is movable in accordance with rotation of the first gear 100.

The third protrusion 150 protrudes outward in the first direction from the outer surface of the disk-shaped part 120. The third protrusion 150 extends radially outward from the cylindrical part 110 on the outer surface of the disk-shaped part 120. The third protrusion 150 is at a different position from the first gear teeth part 130 in a rotational direction of the first gear 100. The third protrusion 150 is also at a different position from the first protrusion 140. More specifically, the third protrusion 150 is positioned to be spaced away from the first protrusion 140 in the rotational direction of the first gear 100. The third protrusion 150 is movable in accordance with rotation of the first gear 100.

With respect to a radial direction of the first gear 100, the first protrusion 140 and third protrusion 150 are at such positions that the first protrusion 140 and third protrusion 150 can respectively contact the lever 70. A radially-outermost end of each of the first protrusion 140 and third protrusion 150 has a certain length in the rotational direction of the first gear 100. The length of the radially-outermost end of the third protrusion 150 is greater than the length of the radially-outermost end of the protrusion 140 in the rotational direction of the first gear 100.

Figure 7A:
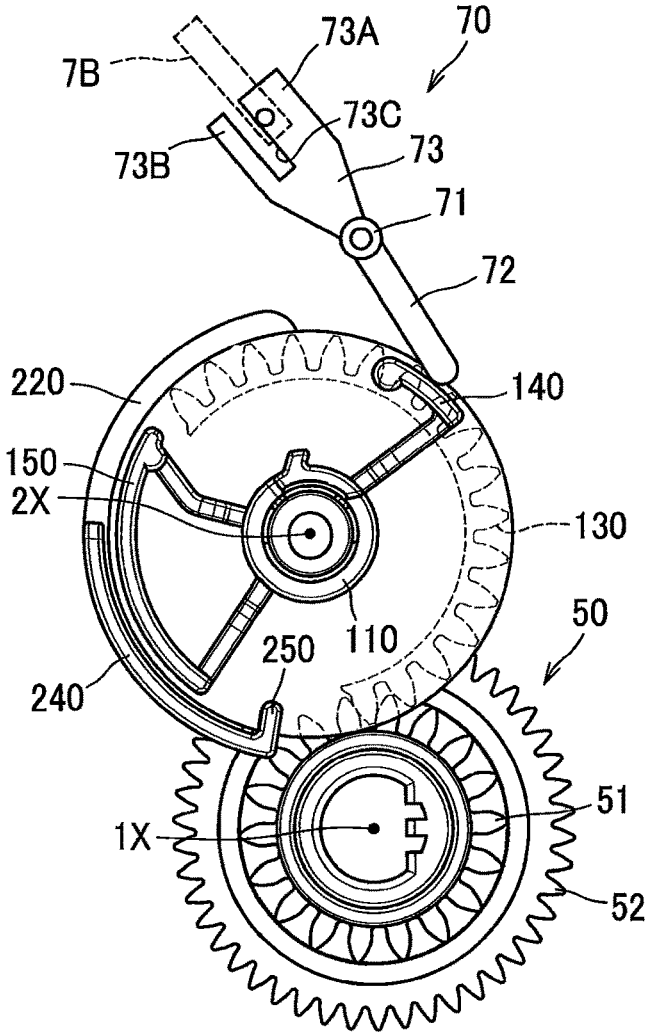
FIG. 7A is a view illustrating the first gear and the second gear of the developing cartridge according to the embodiment as viewed from a perspective outward thereof in the first direction, and illustrating a state where each of the first gear and the second gear is in its initial position.
Figure 12A:
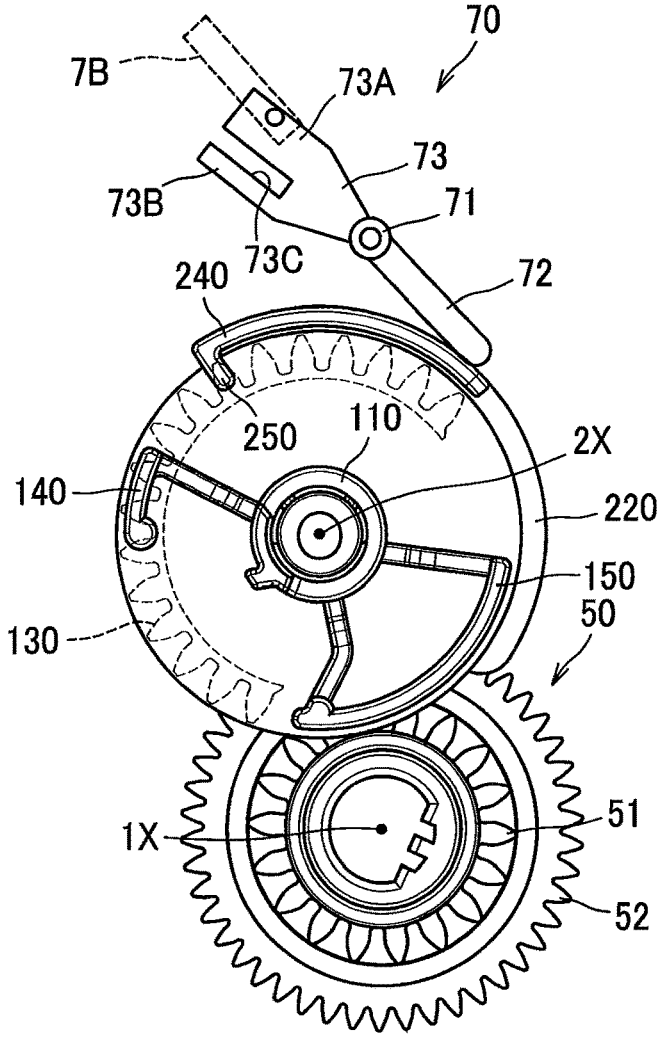
FIG. 12A is a view corresponding to FIG. 7A and illustrating a state where each of the first gear and the second gear is in its final position.

The first gear 100 is rotatable from an initial position shown in FIG. 7A (where the first gear teeth part 130 is in meshing engagement with the small-diameter gear part 51) to a final position shown in FIG. 12A (where the first gear teeth part 130 no longer meshes with the small-diameter gear part 51).

Referring back to FIG. 4, the second gear 200 is rotatable about the second axis 2X. The second gear 200 is a separate member from the first gear 100. The second gear 200 is rotatable by meshing engagement thereof with the drive gear 50.

The second gear 200 includes a cylindrical part 210, a disk-shaped part 220, a second gear teeth part 230, the second protrusion 240 and an engaging protrusion 250. The disk-shaped part 220 and second gear teeth part 230 are positioned on an inner surface of the disk-shaped part 220 in the first direction. The second protrusion 240 and engaging protrusion 250 are positioned on an outer surface of the disk-shaped part 220 in the first direction.

Figure 6A:
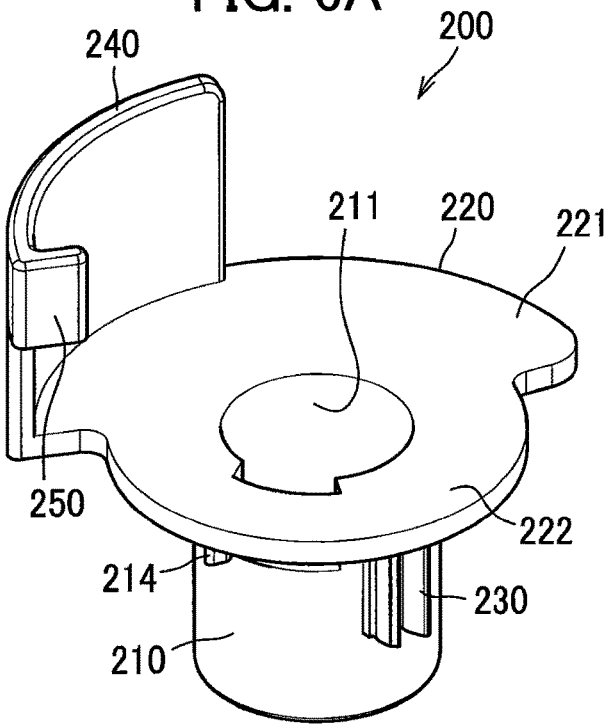
FIG. 6A is a perspective view of a second gear constituting the one end portion of the developing cartridge according to the embodiment as viewed from a perspective outward thereof in the first direction.
Figure 6B:
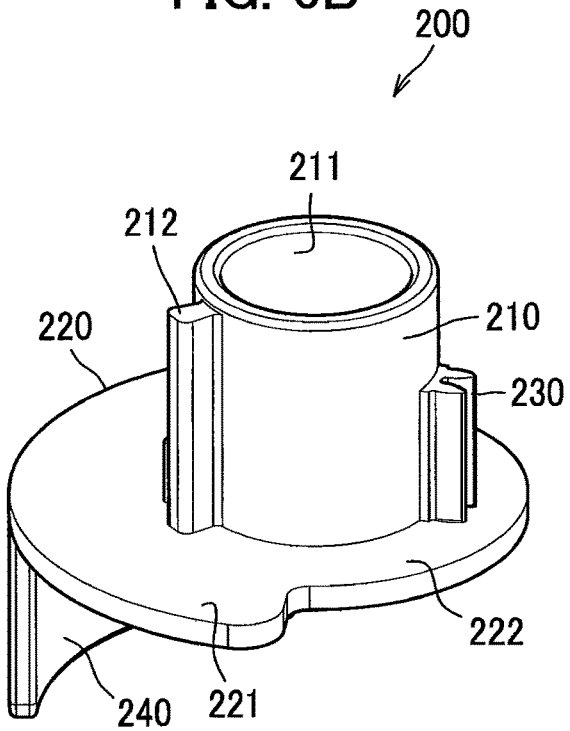
FIG. 6B is a perspective view of the second gear of the developing cartridge according to the embodiment as viewed from a perspective inward thereof in the first direction.
Figure 6C:
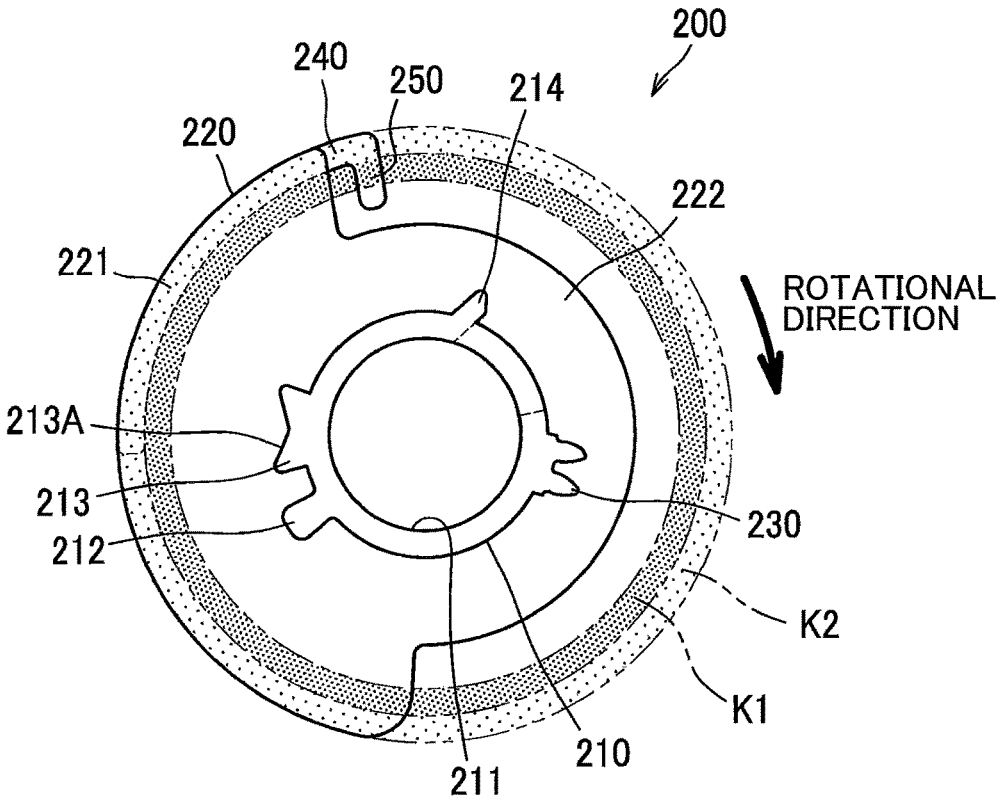
FIG. 6C is a plan view of the second gear of the developing cartridge according to the embodiment as viewed from a perspective inward thereof in the first direction.

As illustrated in FIGS. 6A to 6C, the cylindrical part 210 has a hole 211, and includes a first protruding part 212, a second protruding part 213, and a third protruding part 214.

The cylindrical part 110 of the first gear 100 is inserted in the hole 211 of the cylindrical part 210 of the second gear 200, as illustrated I FIG. 4. The second gear 200 is thus rotatable about the cylindrical part 110 of the first gear 100. That is, the second gear 200 is rotatable relative to the first gear 100.

As illustrated in FIG. 6C, the first protruding part 212, second protruding part 213 and third protruding part 214 protrude radially outward from an outer peripheral surface of the cylindrical part 210. The first protruding part 212, second protruding part 213 and third protruding part 214 are provided at different positions from one another in a rotational direction of the second gear 200.

Figure 12B:
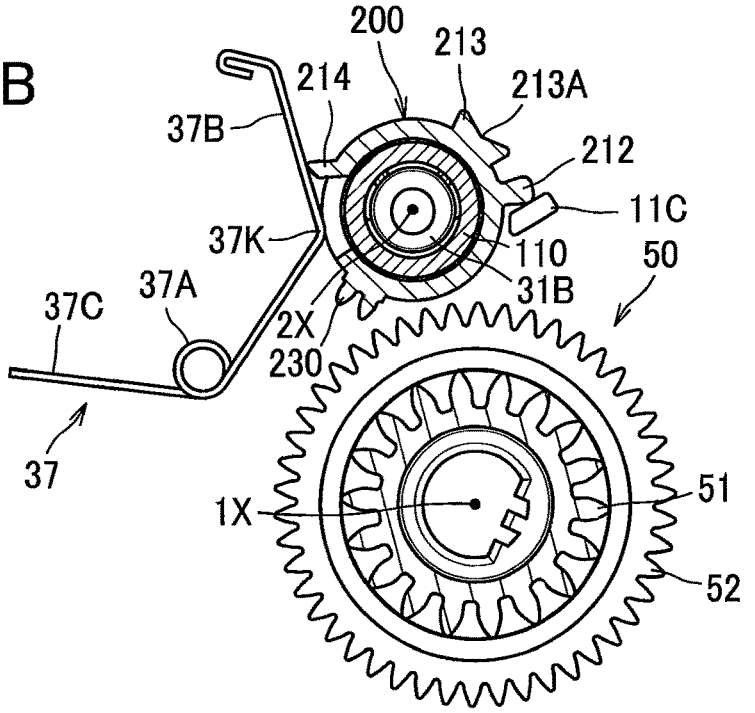
FIG. 12B is a cross-sectional view corresponding to FIG. 7B and illustrating a state where each of the first gear and the second gear is in its final position.

In the final position of the second gear 200, the first protruding part 212 contacts the stopper 11C of the casing 11 to restrict rotation of the second gear 200 (see FIG. 12B). The second protruding part 213 has a recess 213A that is recessed radially inward. In the initial position of the second gear 200, the bent portion 37K of the torsion spring 37 is engaged in the recess 213A to restrict rotation of the second gear 200 in the initial position (see FIG. 7B). The third protruding part 214 contacts the torsion spring 37 to be urged by the torsion spring 37 while the second gear 200 is at the final position so that the first protruding part 212 is urged toward the stopper 11C in the rotation directional of the second gear 200 (see FIG. 12B).

The disk-shaped part 220 extends in a direction crossing the axial direction. Preferably, the disk-shaped part 220 extends in a direction orthogonal to the axial direction. The disk-shaped part 220 has a circular plate-like shape. The disk-shaped part 220 has a large-diameter portion 221 and a small-diameter portion 222. The large-diameter portion 221 has a larger diameter than the small-diameter portion 222.

The second gear teeth part 230 is on an outer peripheral surface of the cylindrical part 210 to extend along a portion of the outer peripheral surface of the cylindrical part 210. The second gear teeth part 230 includes at least one gear tooth. The second gear teeth part 230 is meshingly engageable with the large-diameter gear part 52 of the drive gear 50.

The first protruding part 212, second protruding part 213, third protruding part 214 and second gear teeth part 230 are at different positions from one another. More specifically, the first protruding part 212, second protruding part 213, third protruding part 214 and second gear teeth part 230 are arranged in this order on the outer peripheral surface of the cylindrical part 210 in the rotational direction of the second gear 200 (clockwise in FIG. 6C).

The second protrusion 240 protrudes outward from the disk-shaped part 220 in the first direction (see FIG. 4). As depicted in FIG. 6C, when viewed in the first direction, the second protrusion 240 is at a different position from the second gear teeth part 230 in the rotational direction of the second gear 200. The second protrusion 240 is movable in accordance with rotation of the second gear 200.

In a state where the first gear 100 and second gear 200 are assembled to the casing 11, the second protrusion 240 is positioned farther away from the second axis 2X than the first protrusion 140 of the first gear 100 is from the second axis 2X (see FIG. 7A). In FIG. 6C, K1 represents a locus defined by movement of the first protrusion 140 (indicated by dense hatching), whereas K2 represents a locus defined by movement of the second protrusion 240 (indicated by pale hatching). The locus K1 defined by the first protrusion 140 is positioned inward of the locus K2 defined by the second protrusion 240.

The engaging protrusion 250 extends radially inward from one end of the second protrusion 240. The engaging protrusion 250 is positioned radially inward of the locus K2 defined by the movement of the second protrusion 240. The engaging protrusion 250 is movable together with the second protrusion 240. The engaging protrusion 250 is at a position coincident with a position of the first protrusion 140 with respect to a radial direction of the second gear 200. Accordingly, as the first gear 100 rotates, the first protrusion 140 comes into contact with the engaging protrusion 250 (refer to FIG. 9).

Figure 7B:
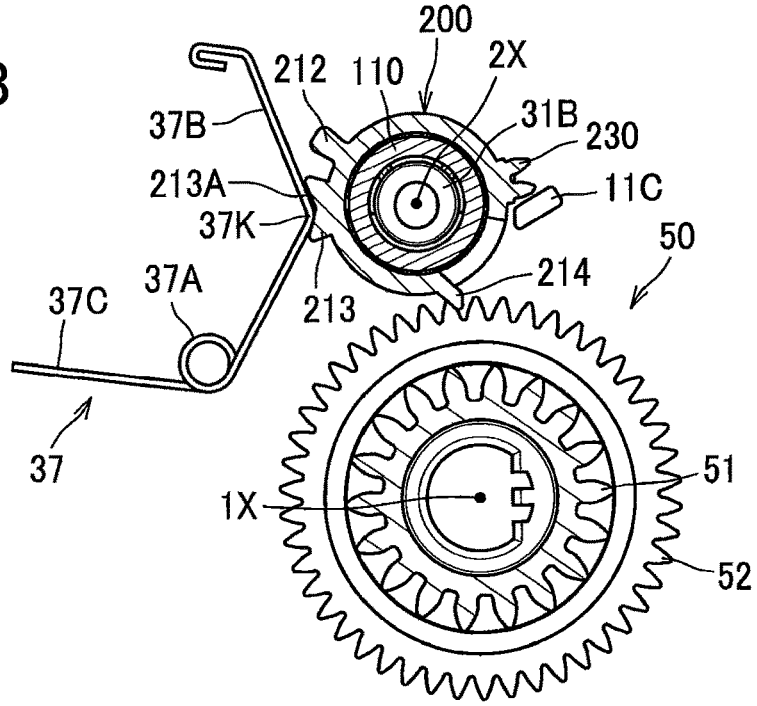
FIG. 7B is a cross-sectional view illustrating the first gear and the second gear of the developing cartridge according to the embodiment taken along a plane passing through a second gear teeth part of each of the first gear and the second gear of FIG. 7A.

The second gear 200 is rotatable from an initial position shown in FIG. 7B, to a transmission position shown in FIGS. 10B to 11B, and then to a final position shown in FIG. 12B. In the initial position, the second gear teeth part 230 does not meshingly engages the large-diameter gear part 52 of the drive gear 50. While the second gear 200 is in the transmission position, the second gear teeth part 230 is in meshing engagement with the large-diameter gear part 52. When the second gear 200 comes to the final position, the meshing engagement between the second gear teeth part 230 and the large-diameter gear part 52 is released.

Referring to FIG. 7A, the lever 70 includes a shaft part 71, a contact part 72, and a shielding part 73. The shaft part 71 is rotatably supported by the main body housing 2. The contact part 72 extends from the shaft part 71.

The shielding part 73 extends from the shaft part 71 in a direction opposite to a direction in which the contact part 72 extends from the shaft part 71. The shielding part 73 includes a first shielding portion 73A, a second shielding portion 73B, and a notched portion 73C. The first shielding portion 73A and second shielding portion 73B are capable of shielding light emitted from the optical sensor 7B. With respect to a pivoting direction of the lever 70, the notched portion 73C is positioned between the first shielding portion 73A and second shielding portion 73B. The light from the optical sensor 7B is allowed to pass through the notched portion 73C.

Figure 8:
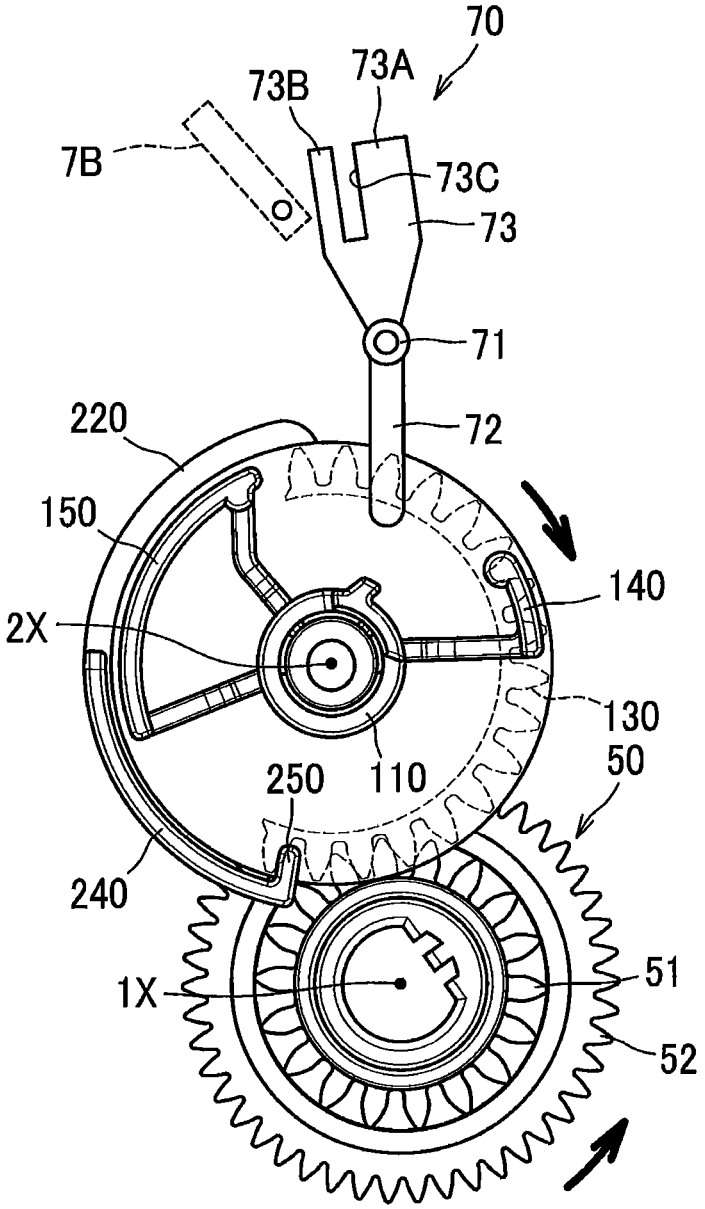
FIG. 8 is a view corresponding to FIG. 7A after a state of FIG. 7A.

The lever 70 is movable among a first lever position shown in FIG. 8, a second lever position shown in FIG. 7A, and a third lever position shown in FIG. 12A. In the first lever position, the contact part 72 is located in the locus K1 defined by movement of the first protrusion 140, the locus K2 defined by movement of the second protrusion 240 and a locus defined by movement of the third protrusion 150. The lever 70 is urged toward the first lever position from the third lever position by a spring (not illustrated).

In the second lever position, the lever 70 is supported on an outer peripheral surface of the first protrusion 140 or an outer peripheral surface of the third protrusion 150. While the lever 70 is in the second lever position, the light from the optical sensor 7B is blocked by a portion of the first shielding portion 73A near the second shielding portion 73B.

In the third lever position, the lever 70 is supported on an outer peripheral surface of the second protrusion 240. While the lever 70 is in the third lever position, the light from the optical sensor 7B is blocked by a portion of the first shielding portion 73A farther away from the second shielding portion 73B.

In the present embodiment, the control device CU is configured to determine the optical sensor 7B is ON when the lever 70 blocks the light from the optical sensor 7B, whereas the control device CU is configured to determine the optical sensor 7B is OFF when the lever 70 does not block the light from the optical sensor 7B. Conversely, the control device CU may determine: the optical sensor 7B is OFF when the light from the optical sensor 7B is blocked; and the optical sensor 7B is ON when the light from the optical sensor 7B is not blocked by the lever 70.

Hereinafter, operations of the developing cartridge 10 with the above structure will be described with reference to FIGS. 7A through 12B and a timing chart of FIG. 13.

In an unused state of the developing cartridge 10, the drive gear 50, first gear 100 and second gear 200 are respectively in initial positions thereof depicted in FIGS. 7A and 7B. As illustrated in FIG. 3, the first protrusion 140 is exposed through the opening 31A of the gear cover 31 while the first gear 100 is in its initial position. The contact part 72 of the lever 70 is in contact with the first protrusion 140 as illustrated in FIG. 7A. The lever 70 is therefore in the second lever position and the sensor 7 is rendered ON.

As the drive gear 50 starts rotating upon receipt of a driving force from the main body housing 2 through the agitator 14 (at a time t0), the first gear 100 meshing with the drive gear 50 starts rotating at a first rotation speed ω1. In accordance with rotation of the first gear 100, the first protrusion 140 moves in the rotational direction, which causes the lever 70 to be disengaged from the first protrusion 140. An urging force of the non-illustrated spring moves the lever 70 to the first lever position. The lever 70 no longer interrupts the light from the optical sensor 7B (see FIG. 8), the optical sensor 7B is rendered OFF from a time t1 to a time t2 in FIG. 13.

Note that, while the lever 70 moves from the second lever position (FIG. 7A) to the first lever position (FIG. 8), the light from the optical sensor 7B passes through the notched portion 73C of the shielding part 73 for a very short period of time. However, the control device CU does not detect that the sensor 7 becomes OFF during this brief period of time, since the lever 70 is moved very quickly by the urging force of the spring.

As the first gear 100 further rotates, the third protrusion 150 then comes into contact with the lever 70. This contact causes the lever 70 to move from the first lever position to the second lever position at a first speed V1. During the movement of the lever 70 at the first speed V1, the second shielding portion 73B, notched portion 73C and first shielding portion 73A sequentially transverse the light from the optical sensor 7B at the first speed V1. As a result, as illustrated in FIG. 13, a signal SG1 indicative of a low signal appears in output of the sensor 7 from the time t2. In the low-speed signal SG1, ON lasts for a second period of time T2, and then OFF lasts for a third period of time T3.

Figure 9:
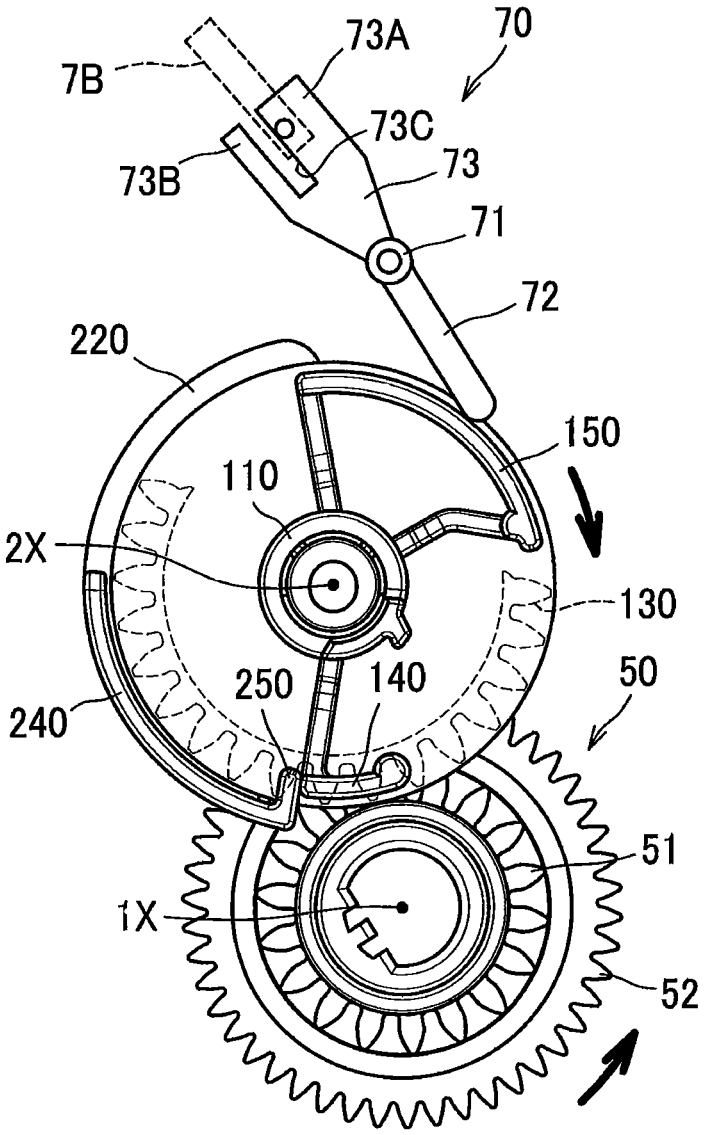
FIG. 9 is a view corresponding to FIG. 7A after a state of FIG. 8.

As the first gear 100 further rotates, the first protrusion 140 contacts the engaging protrusion 250 of the second gear 200 and starts pushing the engaging protrusion 250, as illustrated in FIG. 9. As the first protrusion 140 pushes the engaging protrusion 250, the second gear 200 starts rotating together with the first gear 100 at the first rotation speed ω1 (at a time t3).

Figure 10A:
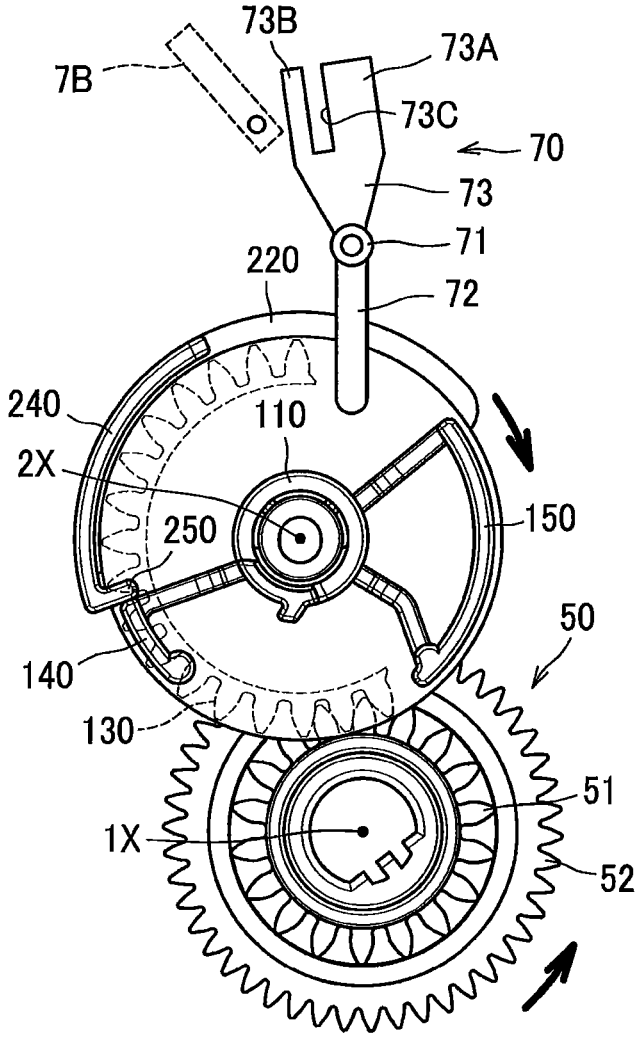
FIG. 10A is a view corresponding to FIG. 7A after a state of FIG. 9.
Figure 13:
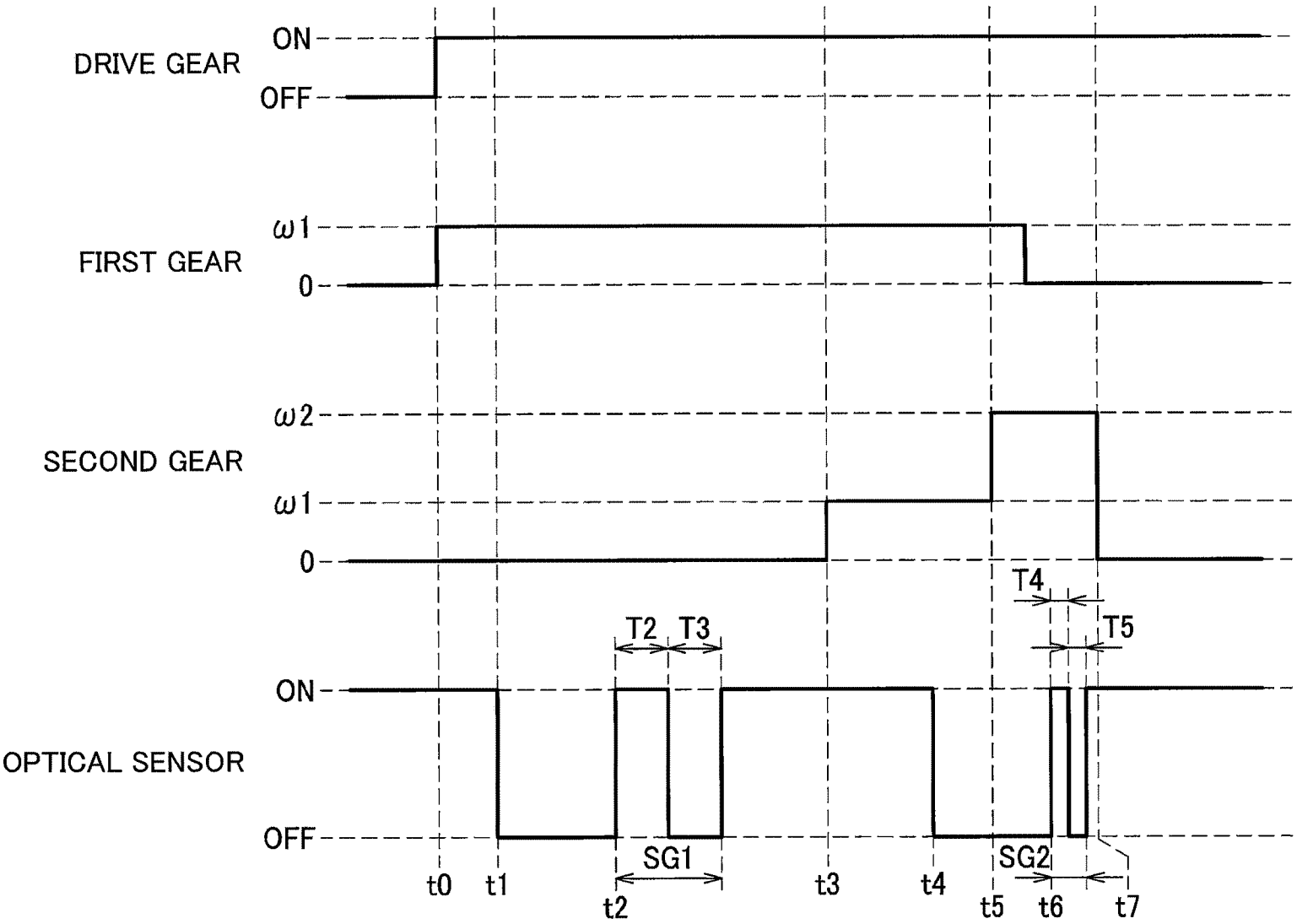
FIG. 13 is a timing chart illustrating operations of the first gear, the second gear and a drive gear of the developing cartridge according to the embodiment and operations of an optical sensor of the laser printer.

As the second gear 200 and the first gear 100 pushing the second gear 200 rotate together, the third protrusion 150 of the first gear 100 is disengaged from the lever 70 so that the lever 70 moves back to the first lever position due to the urging force of the spring (not shown) at a time t4 in FIG. 13. The lever 70 no longer blocks the light of the optical sensor 7B, as shown in FIG. 10A, and, hence, the sensor 7 is rendered OFF.

Incidentally, while the lever 70 moves from the second lever position (FIG. 9) to the first lever position (FIG. 10A), the light from the optical sensor 7B passes through the notched portion 73C of the shielding part 73 for a very short period of time. However, the control device CU does not detect that the sensor 7 is rendered OFF during this brief period of time, since the lever 70 is moved very quickly by the urging force of the spring.

Figure 10B:
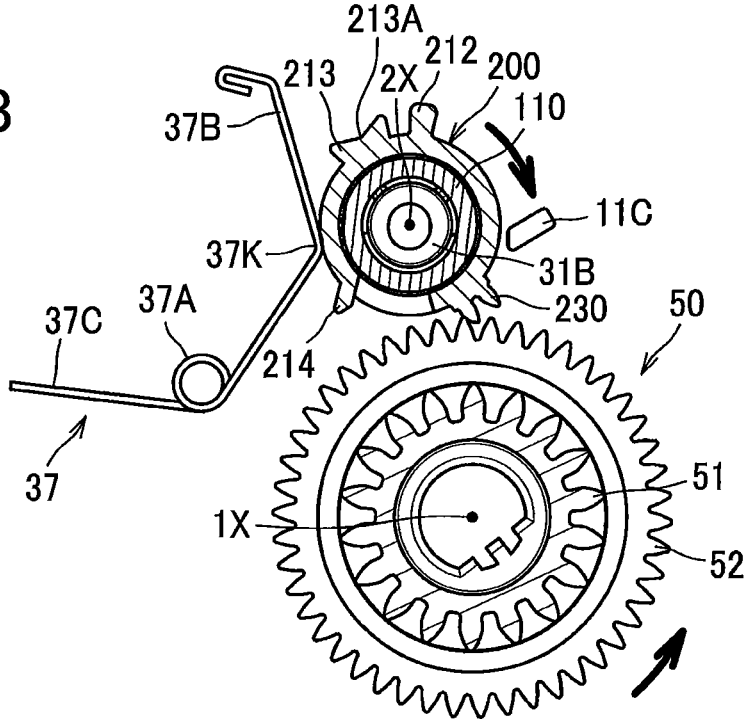
FIG. 10B is a cross-sectional view corresponding to FIG. 7B after the state of FIG. 9.

Subsequently, as illustrated in FIG. 10B, the second gear 200 comes into meshing with the large-diameter gear part 52 of the drive gear 50 (at a time t5). At the time when the large-diameter gear part 52 starts meshing with the second gear teeth part 230, the small-diameter gear part 51 is in meshing engagement with the first gear teeth part 130 of the first gear 100. In this way, the first protrusion 140 pushing the engaging protrusion 250 causes the second gear 200 to rotate, which then causes the second gear teeth part 230 to mesh with the large-diameter gear part 52. The meshing between the second gear teeth part 230 and the large-diameter gear part 52 causes the second gear 200 to rotate at a second rotation speed ω2 that is faster than the first rotation speed ω1. In the present embodiment, the second rotation speed ω2 is three times faster than the first rotation speed ω1.

Figure 11A:
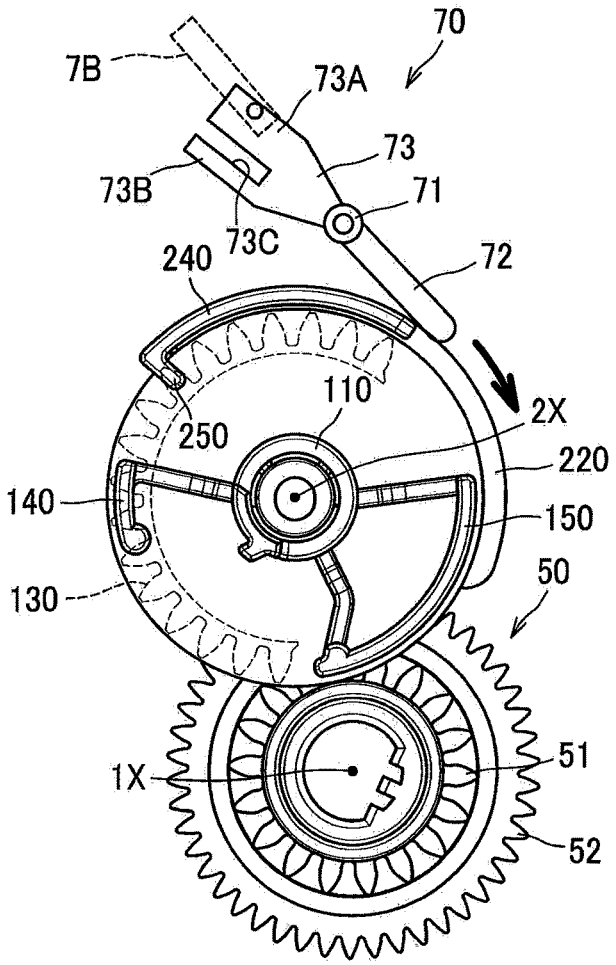
FIG. 11A is a view corresponding to FIG. 7A after a state of FIG. 10A.

As the second gear 200 rotates at the second rotation speed ω2, the second protrusion 240 comes into contact with the lever 70 (at a time t6), as illustrated in FIG. 11A. This contact causes the lever 70 to move from the first lever position to the third lever position at a second speed V2 faster than the first speed V1, since the second gear 200 rotates at the second rotation speed ω2 faster than the first rotation speed ω1.

As the lever 70 moves at the second speed V2, the second shielding portion 73B, the notched portion 73C and the first shielding portion 73A sequentially transverse the light of the optical sensor 7B at the second speed V2. As a result, as illustrated in FIG. 13, a signal SG2 indicative of a high signal appears in output of the sensor 7 from the time t6. In the high-speed signal SG2, ON lasts for a fourth period of time T4, and then OFF lasts for a fifth period of time T5. The high-speed signal SG2 continues for a shorter period of time than the low-speed signal SG1 does. In the present embodiment, a duration of the high-speed signal SG2 is approximately one third of a duration of the low-speed signal SG1.

Once the meshing between the first gear 100 and drive gear 50 is released, the first gear 100 stops rotating. With regard to the second gear 200, after the second gear teeth part 230 is disengaged from the second gear 200, the third protruding part 214 comes into contact with the torsion spring 37.

Figure 11B:
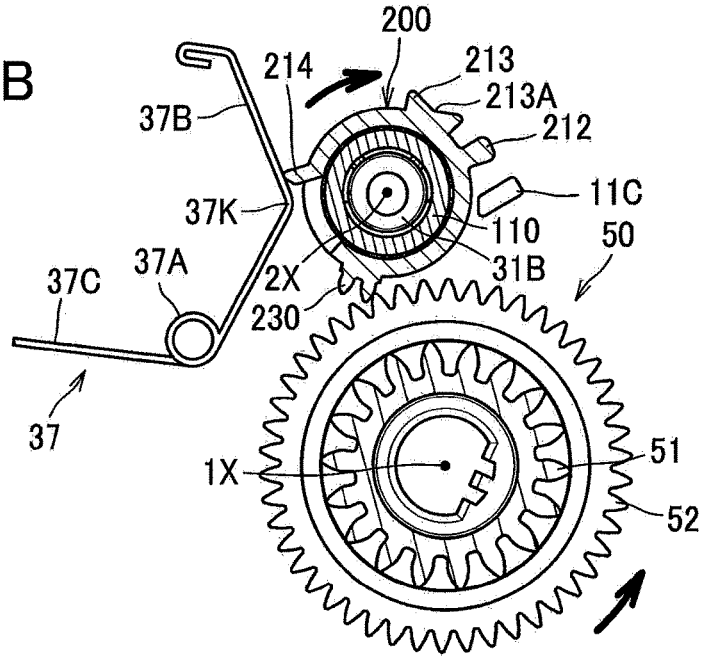
FIG. 11B is a cross-sectional view corresponding to FIG. 7B after the state of FIG. 10B.

After the contact with the torsion spring 37, the third protruding part 214 is pressed by the torsion spring 37 to be moved to a position shown in FIG. 12B from a position shown in FIG. 11B. Subsequently, the first protruding part 212 abuts on the stopper 11C of the main body housing 2, thereby terminating rotation of the second gear 200 (at a time t7).

In this way, each of the drive gear 50, the first gear 100 and the second gear 200 comes to the final position illustrated in FIGS. 12A and 12B. In the respective final positions, neither the first gear 100 nor the second gear 200 is in mesh with the drive gear 50. Accordingly, the first gear 100 and second gear 200 are both kept in their final positions, even though the drive gear 50 keeps rotating. The lever 70 is kept in contact with the second protrusion 240, and hence, the lever 70 is maintained its ON state.

As described above and illustrated in FIG. 13, the signal of the sensor 7 is configured to be switched between ON and OFF eight times once the drive gear 50 is started to rotate (at the time t0). This switching pattern in the signal of the sensor 7 (lengths of the OFF signal and/or ON signal, a number of switching in the signal, differences in timing of the switching) can be made variant according to a number of protrusions provided in each of the first gear 100 and second gear 200, a gear ratio between the drive gear 50 and the first gear 100, and a gear ratio between the drive gear 50 and the second gear 200. The signal switching patterns can be associated with respective specifications of the developing cartridges 10, so that the control device CU can identify the specification of the developing cartridge 10 attached to the main body housing 2.

In a case where a used developing cartridge 10 is attached to the main body housing 2 of the laser printer 1, the first gear 100 and second gear 200 of the used developing cartridge 10 are respectively in their final positions. The second protrusion 240 of the used developing cartridge 10 is substantially at the same position as the second protrusion 240 of the unused new developing cartridge 10. Hence, even if the used developing cartridge 10 is attached to the main body housing 2, the control device CU can detect that the developing cartridge 10 is attached to the main body housing 2 since the second protrusion 240 makes contact with the lever 70.

With the described structure of the developing cartridge 10 according to the embodiment, the second gear 200 is configured to come into meshing engagement with the large-diameter gear part 52 to start rotating after the first gear 100 meshing with the small-diameter gear part 51 is angularly rotated for a prescribed angle. Hence, the second gear 200 can be rotated at a different rotation speed from the first gear 100 after a prescribed period of time has elapsed from when the first gear 100 is started to rotate. The developing cartridge 10 of the embodiment can thus include a novel gear structure for identifying a specification of the developing cartridge 10.

The second gear 200 is first pushed by the first gear 100 to rotate together with the first gear 100 at the first rotation speed ω1, and subsequently meshes with the large-diameter gear part 52 to rotate at the second rotation speed ω2 faster than the first rotation speed ω1. In this way, the second gear 200 can be rotated reliably with a simple structure.

The first protrusion 140 of the first gear 100 pushes the engaging protrusion 250 of the second gear 200 to start rotating the second gear 200, thereby causing the second gear teeth part 230 to mesh with the large-diameter gear part 52 of the drive gear 50. The simple structure of the embodiment can reliably move the second gear 200.

Further, in the first gear 100, the third protrusion 150 is arranged at a different position from the first protrusion 140 in the rotational direction of the first gear 100. This provision of the third protrusion 150 can contribute to diversification of the specifications of the developing cartridges 10.

While the description has been made in detail with reference to the embodiment, it would be apparent to those skilled in the art that various modifications and variations may be made thereto without departing from the scope of the disclosure.

For example, in the depicted embodiment, the second gear 200 is caused to rotate by being directly contacted and pressed by the first gear 100. However, the second gear 200 may be configured to be pressed indirectly by the first gear 100 through a separate part (component) from the first gear 100.

In the embodiment, the first protrusion 140 and the third protrusion 150 are integrally formed with the first gear 100, and the second protrusion 240 is integrally formed with the second gear 200. However, the first protrusion 140, second protrusion 240 and third protrusion 150 may be provided independently from the first gear 100 and second gear 200.

The drive gear 50 of the embodiment is an agitator gear rotatable together with the agitator 14. Alternatively, the drive gear 50 may be provided independently of the agitator gear.

In the depicted embodiment, the developing cartridge 10 and the photosensitive cartridge 5 are provided separately. However, the developing cartridge 10 may be provided integrally with the photosensitive cartridge 5.

In the above-described embodiment, the monochromatic laser printer 1 is employed as an example of an image forming apparatus. However, the image forming apparatus may be a color image forming apparatus, an apparatus that employs an LED for exposure, a copying machine, or a multifunction peripheral.

The elements in the embodiment and modifications thereof may be arbitrarily combined to be implemented.

<Remarks>

The developing cartridge 10 is an example of a developing cartridge. The casing 11 is an example of a casing. The drive gear 50 is an example of a drive gear. The small-diameter gear part 51 is an example of a small-diameter gear part. The large-diameter gear part 52 is an example of a large-diameter gear part. The first gear 100 is an example of a first gear. The first gear teeth part 130 is an example of a first gear teeth part. The first protrusion 140 is an example of a first protrusion. The second gear 200 is an example of a second gear. The second gear teeth part 230 is an example of a second gear teeth part. The second protrusion 240 is an example of a second protrusion. The third protrusion 150 is an example of a third protrusion. The locus K1 is an example of a first locus. The locus K2 is an example of a second locus.

What is claimed is:

1. A developing cartridge comprising:

a casing configured to accommodate developer therein;

a drive gear comprising:

a small-diameter gear part; and a large-diameter gear part having a diameter greater than a diameter of the small-diameter gear part;

a first gear having a peripheral surface and comprising:

a first gear teeth part having a plurality of gear teeth along a portion of the peripheral surface, the first gear teeth part being meshingly engageable with the small-diameter gear part; and a first protrusion movable in accordance with rotation of the first gear teeth part; and a second gear rotatable relative to the first gear, the second gear having a peripheral surface and comprising:

a second gear teeth part having at least one gear tooth along a portion of the peripheral surface of the second gear, the second gear teeth part being meshingly engageable with the large-diameter gear part; and a second protrusion movable in accordance with rotation of the second gear teeth part, wherein the second gear teeth part is configured to meshingly engage with the large-diameter gear part to rotate the second gear after the first gear rotates by a prescribed angle by meshing engagement between the small-diameter gear part and the first gear teeth part.

2. The developing cartridge according to claim 1, wherein the second gear is pushed by the first gear to start rotating together with the first gear at a first rotation speed; and wherein the second gear comes into meshing engagement with the large-diameter gear part to start rotating at a second rotation speed faster than the first rotation speed.

3. The developing cartridge according to claim 2, wherein the first protrusion defines a first locus as a result of rotation of the first gear, and the second protrusion defines a second locus as a result of rotation of the second gear, the first locus being positioned radially inward of the second locus.

4. The developing cartridge according to claim 3, wherein the second gear further comprises an engaging protrusion positioned radially inward of the second locus and movable along with the second protrusion; and wherein the first protrusion is configured to push the engaging protrusion to rotate the second gear so that the second gear teeth part is brought into meshing engagement with the large-diameter gear part.

5. The developing cartridge according to claim 1, wherein the small-diameter gear part is in meshing engagement with the first gear teeth part at a time when the meshing engagement between the large-diameter gear part and the second gear teeth part is started.

6. The developing cartridge according to claim 1, wherein the first gear further comprises a third protrusion positioned at a position different from a position of the first protrusion, the third protrusion being movable in accordance with rotation of the first gear teeth part.

7. The developing cartridge according to claim 1, further comprising an agitator configured to agitate the developer accommodated in the casing, wherein the agitator is rotatable about an axis about which the drive gear is rotatable as an agitator gear.

8. The developing cartridge according to claim 1, wherein the first gear is rotatable, from an initial position where the first gear teeth part is in meshing engagement with the small-diameter gear part, to a final position where the meshing engagement between the first gear teeth part and the small-diameter gear part is released.

9. The developing cartridge according to claim 1, wherein the second gear is rotatable from an initial position where the second gear teeth part is disengaged from the large-diameter gear part, to a final position where the meshing engagement between the second gear teeth part and the large-diameter gear part is released, via a transmission position where the second gear teeth part is in meshing engagement with the large-diameter gear part.

10. The developing cartridge according to claim 1, wherein the drive gear is rotatable about a first axis extending in an axial direction;

wherein the first gear is rotatable about a second axis extending in the axial direction; and wherein the second gear is rotatable about the second axis.

* * * * *